United States Patent [19]

Liesch et al.

[11] Patent Number: 4,647,020

[45] Date of Patent: Mar. 3, 1987

[54] GAS-PERMEABLE ELEMENT OF A REFRACTORY MATERIAL

[75] Inventors: Jean-Francois Liesch, Luxembourg, Luxembourg; Friedrich Kassegger, Wiener Neustadt; Rudolf Handler, Goettschach, both of Austria

[73] Assignee: Arbed S.A., Luxembourg, Luxembourg

[21] Appl. No.: 681,215

[22] Filed: Dec. 12, 1984

[30] Foreign Application Priority Data

Dec. 12, 1983 [LU] Luxembourg ..... 85131

[51] Int. Cl.[4] ..... C21C 5/34

[52] U.S. Cl. ..... 266/270; 266/218

[58] Field of Search ..... 266/218, 220, 265, 266, 266/270, 285

[56] References Cited

U.S. PATENT DOCUMENTS

| | | | |
|---|---|---|---|
| 4,238,121 | 12/1980 | Harita et al. | 266/285 |
| 4,296,921 | 10/1981 | Hayashi | 266/270 |
| 4,340,208 | 7/1982 | Vayssiere et al. | 266/220 |
| 4,413,815 | 11/1983 | Duhomez et al. | 266/266 |
| 4,539,043 | 9/1985 | Miyawaki et al. | 266/266 |

FOREIGN PATENT DOCUMENTS

| | | | |
|---|---|---|---|
| 0064449 | 11/1982 | European Pat. Off. . | |
| 0020418 | 2/1984 | Japan | 266/265 |

*Primary Examiner*—L. Dewayne Rutledge
*Assistant Examiner*—Robert L. McDowell
*Attorney, Agent, or Firm*—Michael J. Striker

[57] ABSTRACT

A gas-permeable element of a refractory material for blowing gases into a metal treatment vessel through its lining has a body of a refractory material, a metal housing on the longitudinal sides of the refractory body, a free inner end surface at which the refractory material is exposed, an outer end surface provided with a gas distributing chamber for a gas supply, at least one local opening extending in the interior of the refractory body for a gas passage between the end surfaces and provided with a metal insert, wherein the metal insert is formed as a laterally closed small channel, the gas-distributing chamber is separated from the refractory material by a metal sheet plate, and the metal channel is tightly mounted in the metal sheet plate so that the refractory material is maintained free from loading with a gas pressure.

10 Claims, 9 Drawing Figures

GAS-PERMEABLE ELEMENT OF A REFRACTORY MATERIAL

BACKGROUND OF THE INVENTION

The present invention relates to a gas-permeable element of a refractory material for blowing of gases into metal treatment vessels through their lining.

Oxygen blowing processes which serve for pig-iron refining have been improved in metallurgical sense by controlled blowing of secondary gases such as nitrogen or argon through the converter bottoms. Also, in vessels for oxygen bottom blowing processes and metal treatment, such as furnace ladles, desulfurization ladles and the like, blowing of gases into the metal bath through the vessel bottom or the lining of the vessel wall have been taken into consideration.

The gas-permeable elements which are insertable into the lining of the vessel must satisfy the requirements that their service life corresponds to the life of the remaining refractory lining, since an exchange of worm gas-permeable blocks in hot condition is difficult. Furthermore, the gas passage must be both continuous and especially also discontinuous. In other words, the vessel must be operable also without the gas passage, and after the repeated resumption of the gas supply the insertable elements must be gas-permeable in unchanged manner. Moreover, the gas-permeability of the elements over their time of use, or in other words over an entire campaign must be retained substantially identical.

The above-mentioned requirements are satisfied in the refractory gas-permeable element which is described in the U.S. Pat. No. 4,340,208. The element disclosed in this reference is provided with a metal housing arranged on its longitudinal sides, a free inner end surface, a gas-distributing chamber for a gas supply at the outer end surface, and a local opening extending in the interior of the element for a gas passage between the end surfaces and provided with a metal insert. This element can be composed of segments or strips of a refractory material and metal inserts in the form of steel sheets arranged alternatingly with one another. As disclosed in the LU 81,208, these metal inserts can be flat, wave shape, tubular or wire shaped and have a small wall thickness.

In all these gas-permeable elements the gas passage takes place through narrow gaps which remain between the refractory material and the metal inserts. The refractory material is loaded with the gas pressure which causes a plurality of disadvantages. For preventing lateral swelling of the metal housing which surrounds the refractory material and a lateral discharge of gas into the surrounding masonry which can cause a premature wear, the metal housing must be composed of a steel sheet with a relatively great wall thickness with provision of gas-tight welding seams. For preventing the undesirable and uncontrollable gas passage along the inner wall of the metal housing, a mortar layer must be arranged between the refractory material and the metal housing, which is difficult to put in. When nitrogen is used as a scavenging gas, nitrogenization and also simultaneous carbonization by the frequently carbon-containing refractory material, of the metal housing takes place. Both these processes lead to brittleness and formation of cracks which can undesirably affect the gas passage. When $CO_2$ is used as a scavenging gas, the carbon-containing refractory material is depleted of carbon, and it must be protected at all sides by sheet layers or by lining.

Furthermore, there is a danger that the refractory material is pressed under the action of the gas pressure from the metal housing outwardly and into the metal bath, which can lead to a breakage of the metal bath through the lining.

The EP-A 64,449 discloses an arrangement for blowing of scavenging gas through the bottom or the wall of a converter for metal refining. It includes a distributing chamber which is mounted on the outer surface of the converter wall and is provided with a gas supply. A plurality of cylindrical nozzle pipes extend from the distributing chamber and pass through the converter wall, the permanent lining and the wear lining and extend to the inner surface of the lining. These nozzle pipes are flattened in the region of the wear lining by compression to the inner width of maximum 1mm and advantageously are embedded in respective recesses of the wear lining block. The mounting and replacement of such a blowing device is expensive and time consuming, and at best it can be used effectively only for small converters.

SUMMARY OF THE INVENTION

Accordingly, it is an object of the present invention to provide a gas-permeable element of a refractory material for blowing gases into metal treatment vessels through their lining, which avoids the disadvantages of the prior art.

More particularly, it is an object of the present invention to provide a gas-permeable element which is easily mountable in the refractory lining and replaceable after its wear, and which prevents loading of the refractory material with the gas pressure.

In keeping with these objects and with others which will become apparent hereinafter, one feature of the present invention resides, briefly stated, in a gas-permeable element which has a refractory body provided in its interior with at least one local opening extending between its end surfaces and having a metal insert, wherein the metal insert is formed as at least one laterally closed small channel, a gas-distributing chamber is separated from the refractory material by a metal sheet plate, and the channel is tightly mounted in the sheet metal plate, so that the refractory material is maintained free from loading with gas pressure.

When the gas-permeable element is designed in accordance with the present invention, the refractory material of the element and the metal housing surrounding the refractory material are pressureless. In other words they are free from a pressure loading from the scavenging gas. The metal housing serves mainly as a transporting or mounting aid and it can be composed of a metal sheet with a small thickness of for example 2 mm and less. The provision of gas-tight welding seams and the sealing between the metal housing and the refractory material can be dispensed with when the element is assembled by other means, for example by gluing.

The laterally closed small channel or channels in accordance with present invention are advantageously composed of a steel sheet or a copper sheet. Their inner width amounts to approximately 0.3–1 mm, in dependence upon the desired quantity of gas to be passed therethrough. The metal channels can be inserted in slots or grooves which are formed in the refractory body or in individual prefabricated segments of the body. It is also possible to form a system of passages in an empty metal housing and then to cast or ram the intermediate space with a refractory mass. It is further possible to form only the central part of the refractory body, in which the metal channels are embedded, as a casting or ramming core and to form the edge parts of prefabricated bodies or segments.

When the metal channels have thin walls and the refractory material is subjected to strong thermal expansion as is the case with magnesite material, it is possible that the channels will be compressed and the gas passage will be impaired. This phenomenon cannot be reliably prevented by the insertion of wires into the channels as disclosed in the EP-A 64,449. In this case it is recommended in accordance with the advantageous embodiment of the invention to line the metal channels at their outer side with a lining of a refractory material. This lining can be composed of ceramic fibers, for example asbestos or cerafelt fibers. It is important to select the required material so that it is heat-resistant and also has such properties in condition of different temperatures of the element, which guarantee compensation for the expansion for the surrounding material and the channel. These properties can be such that at the cold side of the element the lining has a higher elasticity, whereas at the warm side facing towards the steel bath it can be partially sintered. The volume reduction produced by sintering is compensated by the expansion of the surrounding refractory material and the channels. The material can be wound around the channels in form of mats. It is to be noted that the layer thickness must not exceed a maximum value of approximately 1 mm, since otherwise a steel infiltration can take place.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
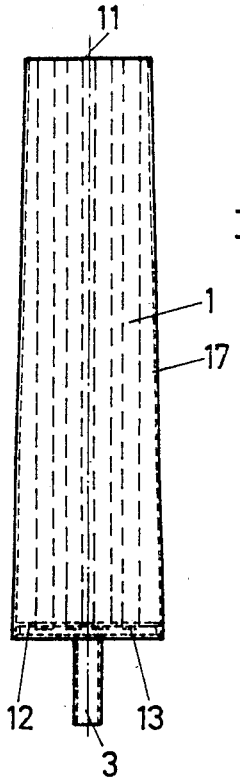
FIG. 1 is an elevation view showing a blowing block suitable for insertion into a bottom of a converter.
Figure 3:
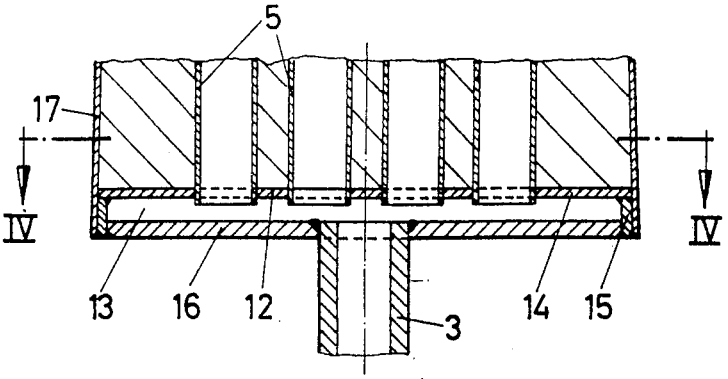
FIG. 3 is a view showing a longitudinal section through a lower or outer part of the blowing block, on an enlarged scale.
Figure 4:
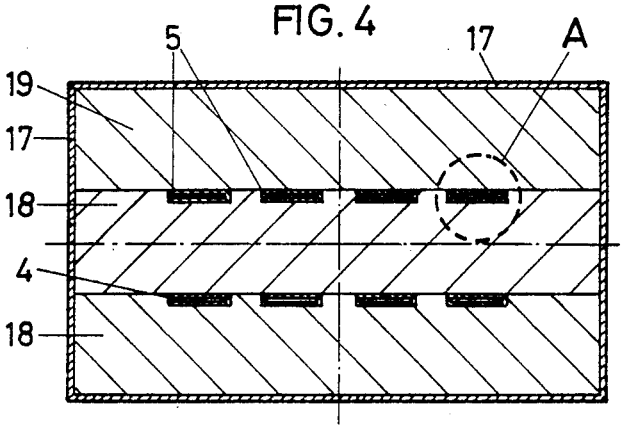
FIG. 4 is a view showing a cross-section taken along the line IV—IV in FIG. 3.
Figure 2:
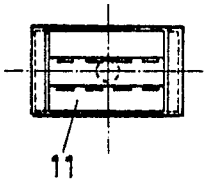
FIG. 2 is a plan view showing upper or inner end surfaces of the blowing block of FIG. 1.

The gas permeable element shown in FIGS. 1–6 is suitable for insertion in a bottom of a converter. A refractory material is exposed on its upper end surface 11 which faces towards the interior of the converter in the inserted condition of the blowing block. A gas distributing chamber 13 is provided at an opposite end surface 12 and extends over the entire end surface 12. The gas distributing chamber 13 is limited by an inner metal sheet plate 14 which lies on the refractory material, small lateral metal sheet strips 15, and an outer base plate 16. A tubular gas supply conduit 3 is mounted in the base plate 16. The blowing block 1 has four side surfaces which are lined with a metal housing 17.

The refractory material of the blowing block 1 is composed of three prefabricated portions or segments 18 and 19 which are held together by the metal housing 17. Two of these segments, namely the segments 18 are provided on their greater longitudinal surface with four flat grooves 4. The grooves 4 extend from the outer and lower end surface 12 of the refractory material toward the inner or upper end surface 11 and therefore extend over the entire length of the refractory material. The grooves 4 can be formed in the segments 8 during their production by respective design of the mold, or they can be made in the finished segments, for example by milling, planing or cutting.

Small metal channels 5 are inserted in the grooves 4 and formed so that they are gas-tight toward their sides. The channels 5 are composed advantageously of steel or copper sheet and have a wall thickness for example of approximately 0.5–1 mm and an inner width of the size of 0.3–1 mm. The channels 5 extend into the respective openings of the inner metal sheet plate 14 of the gas-distributing chamber 13 and are connected with the sheet plate 14 in a gas-tight manner, for example by soldering, welding or gluing. Because of these features the refractory material and the outer metal housing 17 remain free from being loaded by the gas pressure of treatment gases which enter the gas-distributing chamber 13 through the gas supply conduit 3 and pass from the gas-distributing chamber through the small channels 5 into the metal bath.

The maintenance of the channel width within the order of 0.3–1 mm guarantees that the required gas quantity can be supplied through the channels 5 into the metal bath on the one hand, and after periodical turning-off of the gas supply, obstruction of the channels by introduced molten metal is very short and after resumption of the gas supply the channels become again free for blowing, on the other hand.

Figure 5:
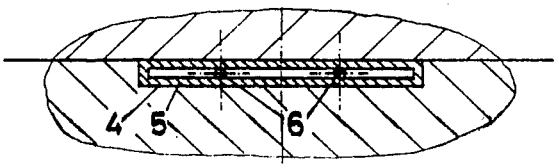
FIG. 5 is a view showing a fragment A of FIG. 4, on an enlarged scale.
Figure 6:
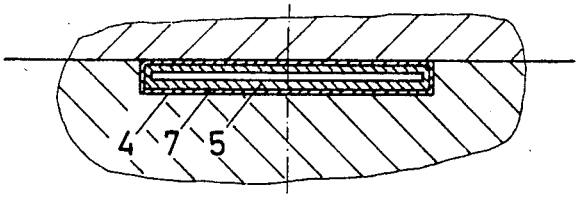
FIG. 6 is a view substantially ccorresponding to the view of FIG. 5, but showing the fragment A in accordance with a different embodiment of the invention.

For preventing compression of the channels by the refractory material which expands under the action of heat, the channels 5 can be provided with known inserts of one or more metal wires 6, as shown in FIG. 5. In accordance with another feature of the present invention, compression of the channels because of the thermal expansion of the refractory material can be prevented by lining outer faces of the channels 5 with a compressible refractory fibrous material 7, for example through winding, as shown in FIG. 6. The fibrous material 7 will absorb the thermal expansion of the refractory material because of its compressibility, so that the compression of the channels 5 is very small. The coating can be formed so that with temperatures over 1000° C. it is at least partly sintered and shrunk so as to reduce its volume. It has a thickness which is at most equal to 1 mm.

Figure 8:
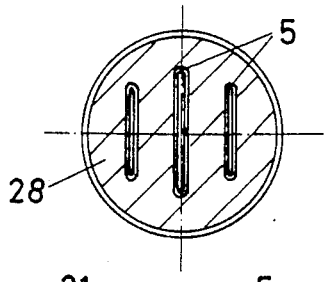
FIG. 8 is plane view of an upper or inner end surface of the scavenging body of FIG. 7.
Figure 9:
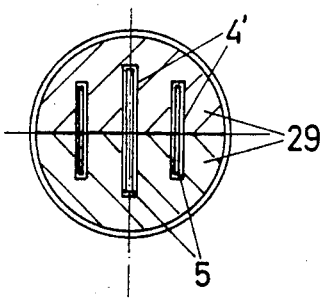
FIG. 9 is a plane view of the upper or inner end surface in accordance with another embodiment of the invention.
Figure 7:
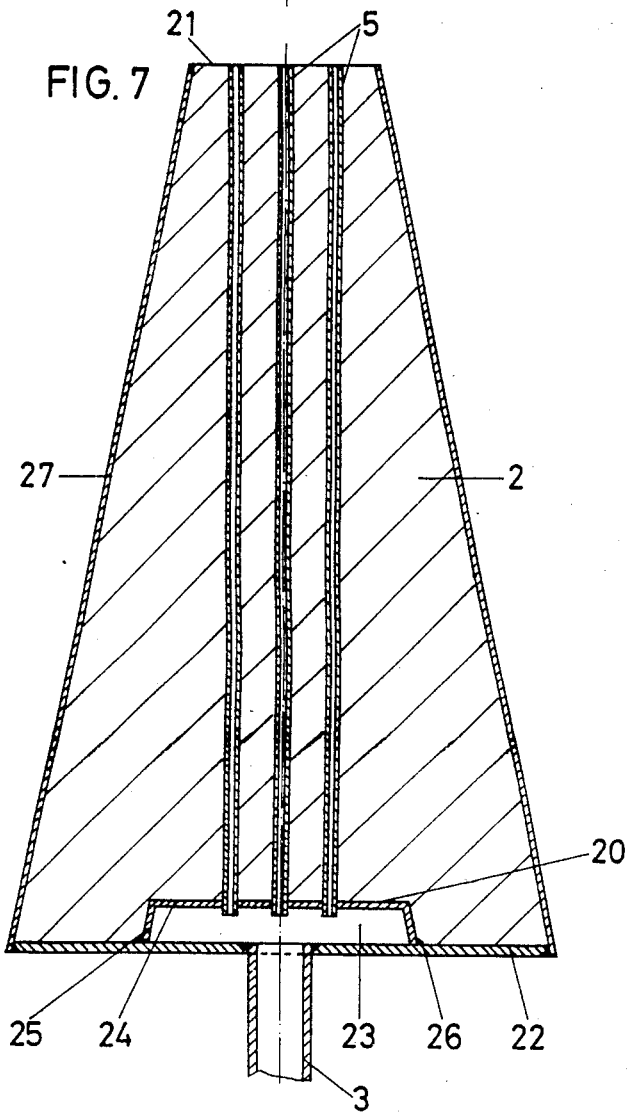
FIG. 7 is a view showing a longitudinal section of a scavenging block suitable for insertion into a bottom of a ladle.

FIGS. 7–9 show a scavenging block 2 which is suitable for insertion in a ladle bottom. It has a shape of a truncated cone which allows easy exchange of such scavenging blocks, since they cooperate with a known corresponding perforated block having truncated coneshaped opening. The scavenging block 2 has a smaller end surface 21 which faces toward the interior of the ladle in inserted condition of the block and at which the refractory material is exposed. The rinsing block has an opposite greater end surface 22 which is provided with a truncated coneshape central depression 20 formed in the refractory material. A gas-distributing chamber 23 is arranged in the depression 20. The gas-distributing chamber 23 is separated from the refractory material by an inner metal sheet plate 24 and a lateral metal sheet ring 25 in a gas-tight manner. It is also closed from outside by a base plate 26 which extends over the entire greater end surface. A central tubular gas supply conduit 3 opens into the gas-distributing chamber 23 through the base plate 22.

Three small metallic channels 5 of the type described herein above are embedded in the refractory material of the scavenging block 2. They extend from the gas-distributing chamber 23 to the free end surface 21, and the scavenging gas can be supplied through the metallic channels 5 into the interior of the ladle. The passages 5 can have different widths, as can be seen from FIGS. 8 and 9. They are mounted in the inner metal sheet plates 24 of the gas-distributing chamber 23 in a gas-tight manner so as to maintain the refractory material and the metal housing 27 in a pressureless condition, or in other words to release them from loading by the gas pressure of the scavenging gas.

In the embodiment shown in FIG. 8 the refractory material of the scavenging block 2 can be composed of a refractory mass. In this case the metal structure composed of the channels 5, the gas-distributing chamber 23, the base plate 26 and the housing 27 is first formed, and there its free space is filled with a refractory casting or ramming means, so that a refractory mass body 28 is produced in which the channels are embedded. Since not only the later thermalexpansion of the refractory material, but also the compressing pressure acts on the channels 5, the danger of the compression is especially high. It is therefore recommended in this case to form the channels 5 as shown in FIG. 6, or in other words to provide them with lining, for example winding over, with a compressible refractory fibrous material 7.

In accordance with another embodiment, the refractory material of the scavenging block 2 can be composed of several prefabricated segments. As can be seen from FIG. 9, two such segments 29 are provided in form of two halves of a truncated cone. They are provided with slots or grooves 4' which complete one another in pairs and are formed for receiving of the channels 5.

Modifications of the above-shown embodiments are also possible. Thus, the gas-distributing chamber 23 of the scavenging block 2 can extend over the outer end surface 22, or the gas-distributing chamber 13 of the blowing block 1 can be limited only to a central region arranged in a depression of the refractory material. The refractory material of the inventive element can be composed for example of sintered or fused magnesia, of a mixture of magnesia and chromite, of prereacted magnesia chromite sintered or fused material, or of highly aluminous material. Also an enrichment of the refractory material with a carbon carrier is possible. The material can be used in form of burnt segments or it can be chemically bound with bitumen or synthetic resin. Also a subsequent impregnation of the prefabricated burnt or bound segments with a carbon carrier, such as tar, bitumen or synthetic resin is possible.

It will be understood that each of the elements described above, or two or more together, may also find a useful application in other types of constructions differing from the types described above.

While the invention has been illustrated and described as embodied as a gas-permeable member of a refractory material for blowing gases into a metal treatment vessel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A gas-permeable element of a refractory material for flowing gases into a metal treatment vessel through its lining, comprising a refractory body having longitudinal sides, a free inner end surface at which a refractory material of said refractory body is exposed, and an opposite outer end surface; at least one local opening extending through said refractory body to form a gas passage between said inner and outer end surfaces and provided with a metal insert, said metal insert being formed as at least one laterally closed thin metal channel arranged in said local opening of said refractory body; a gas-distributing chamber separated from the refractory material of said refractory body by a metal sheet plate, said channel being tightly mounted in said metal sheet plate so that the refractory material of said refractory body is maintained free from loading with a gas pressure, said metal channel having an outer side; and a coating which coats said outer side of said metal channel so as to be located between said emtal channel and said refractory body and is composed of a refractory material having elastic properties so that it absorbs expansions which take place in the gas permeable element and therefore mechanically protects said metal channel.

2. A gas-permeable element as defined in claim 1, wherein said lining is at least partly formed so that with temperatures over 1000° C. it is at least partly sintered and shrunk so as to reduce its volume.

3. A gas-permeable element as defined in claim 1, wherein said lining is composed substantially of ceramic fibers.

4. A gas-permeable element as defined in claim 1, wherein said lining is composed of a mat which is wound around said metal channel.

5. A gas-permeable element as defined in claim 1, wherein said lining has a thickness which is equal to at most 1 mm.

6. A gas-permeable element as defined in claim 1, wherein said refractory body has at least a central part selected from the group consisting of a ramming and casting material, said metal channel being embedded in said central part.

7. A gas-permeable element as defined in claim 1, wherein said refractory body is formed as a one-piece member in which said opening is provided.

8. A gas-permeable element as defined in claim 1, wherein said refractory body is composed of a plurality of segments, said opening being formed in at least one of said segments.

9. A gas-permeable element as defined in claim 1, wherein said refractory body has a central depression, said gas-distributing chamber being arranged in said central depression of said refractory body.

10. A gas-permeable element as defined in claim 1, wherein said metal channel has a wall thickness of approximately 0.5–1 mm and an inner width of approximately 0.3–1 mm.

* * * * *